US010513785B2

(12) United States Patent
Glasscock et al.

(10) Patent No.: US 10,513,785 B2
(45) Date of Patent: Dec. 24, 2019

(54) APPARATUS, SYSTEM AND METHOD FOR TREATMENT OF AN ELECTRIC SUBMERSIBLE PUMP POWER CABLE

(71) Applicant: Summit ESP, LLC, Tulsa, OK (US)

(72) Inventors: Terry L. Glasscock, Vinita, OK (US); Peter J. Kneip, Cody, WY (US); Thomas John Gottschalk, Houston, TX (US); Brent Keith Kashwer, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/412,319

(22) Filed: Jan. 23, 2017

(65) Prior Publication Data

US 2017/0211190 A1 Jul. 27, 2017

Related U.S. Application Data

(60) Provisional application No. 62/286,159, filed on Jan. 22, 2016.

(51) Int. Cl.
*B05C 3/09* (2006.01)
*C23F 11/08* (2006.01)
(Continued)

(52) U.S. Cl.
CPC ..... *C23F 11/08* (2013.01); *B08B 3/022* (2013.01); *B08B 3/041* (2013.01); *B08B 3/10* (2013.01); *B65H 75/00* (2013.01); *E21B 43/128* (2013.01)

(58) Field of Classification Search
CPC .... B05D 1/18; B05C 3/09; H01B 7/02; C23F 11/00; C23F 11/08
(Continued)

(56) References Cited

U.S. PATENT DOCUMENTS 111,511 A * 2/1871 Bomby ..... B05C 3/09 118/416
201,259 A * 3/1878 Maus ..... B05C 3/09 118/416

(Continued)

OTHER PUBLICATIONS

Corrosion protection and rust removal, Wurth.*
CA Application Serial No. 2,955,938, Office Action, dated Jun. 4, 2019, 5 pages.

*Primary Examiner* — Dah-Wei D. Yuan
*Assistant Examiner* — Hai Y Zhang
(74) *Attorney, Agent, or Firm* — Gilliam IP PLLC

(57) ABSTRACT

An apparatus, system and method for treatment of an electric submersible pump (ESP) power cable is described. A method of treating an ESP power cable includes wrapping an ESP power cable around a reel as the cable is removed from a production well to form cable layers, supporting the cable-wrapped reel horizontally above a tank, the reel supported on a shaft extending between actuatable support members, pumping treatment fluid into the tank, lowering the cable-wrapped reel partially into the tank by activating the actuatable support members such that a lower portion of the reel is submerged in the treatment fluid and an inner diameter of the cable-wrapped reel is fluidly coupled to the treatment fluid, rotating the reel around its central axis such that each portion of an outermost layer of the cable is submerged in the treatment fluid at least once to coat the ESP power cable.

16 Claims, 11 Drawing Sheets

(51) Int. Cl.

| | |
|---|---|
| ***E21B 43/12*** | (2006.01) |
| ***B08B 3/10*** | (2006.01) |
| ***B08B 3/02*** | (2006.01) |
| ***B08B 3/04*** | (2006.01) |
| ***B65H 75/00*** | (2006.01) |

(58) Field of Classification Search
USPC ..... 427/430.1; 118/425
See application file for complete search history.

(56) References Cited

U.S. PATENT DOCUMENTS

| | | | | | |
|---|---|---|---|---|---|
| 3,931,748 | A * | 1/1976 | Tertinek | F16H 57/0456 | 74/606 R |
| 3,987,537 | A * | 10/1976 | Warren | G01V 1/201 | 29/592.1 |
| 5,180,014 | A * | 1/1993 | Cox | E21B 19/22 | 166/384 |
| 6,142,406 | A * | 11/2000 | Newman | B21C 47/18 | 166/77.2 |
| 6,587,054 | B2 * | 7/2003 | Besser | H01B 7/046 | 166/66.4 |
| 2015/0122929 | A1 * | 5/2015 | Garton | B65H 75/241 | 242/118.5 |

* cited by examiner

APPARATUS, SYSTEM AND METHOD FOR TREATMENT OF AN ELECTRIC SUBMERSIBLE PUMP POWER CABLE

CROSS REFERENCE TO RELATED APPLICATIONS

This application claims the benefit of U.S. Provisional Application No. 62/286,159 to Glasscock et al., filed Jan. 22, 2016 and entitled "APPARATUS, SYSTEM AND METHOD FOR TREATMENT OF ELECTRIC SUMBERSIBLE PUMP POWER CABLES," which is hereby incorporated by reference in its entirety.

BACKGROUND OF THE INVENTION

1. Field of the Invention

Embodiments of the invention described herein pertain to the field of electric submersible pump (ESP) assemblies. More particularly, but not by way of limitation, one or more embodiments of the invention enable an apparatus, system and method for treatment of an ESP power cable.

2. Description of the Related Art

Submersible pump assemblies are used to artificially lift fluid from underground formations, such as oil, natural gas and/or water wells, to the surface. These wells are typically thousands of feet deep, with the pump assembly placed inside the deep well. A typical electric submersible pump (ESP) assembly consists, from bottom to top, of an electric motor, seal section, pump intake and centrifugal pump, which are all connected together with shafts. The electric motor supplies torque to the shafts, which provides power to the centrifugal pump. The electric motor is generally a two-pole, three-phase, squirrel cage induction design connected by a power cable to a power source located at the surface of the well. The power cable includes a motor lead cable and extension cord, and extends from the downhole motor deep within the well, to the power source at the surface of the well. These ESP power cables are typically between about 4,000 to 12,000 feet in length, depending on well depth, since the cable must extend from the ESP motor deep within the well to the surface where the power source is located.

ESP Power cables conventionally include three insulated copper conductors that are enclosed by a helically wrapped strip of galvanized steel armor. The galvanized steel armor strip on these cables is typically between 20 and 34 mils thick, and the power cable typically weighs about 1.5 pounds per foot. Thus, a 12,000 foot-long power cable weights about 9 tons. When a power cable is new, a zinc coating covers the surface of the galvanized steel armor. The zinc coating protects the cable from rusting before it is deployed. However, during ordinary use of the cable, the zinc coating decays.

ESP power cables are typically the single most expensive component of the ESP assembly. Currently, the cost of an ESP power cable is about $4.00-$12.00 per foot of cable, making the current cost of a 12,000 foot cable as much as $144,000 USD. For this reason, it is often desirable to reuse ESP power cables. In such instances, the cable to be reused is stored between uses. However, since the zinc coating deteriorates during ESP operation, a secondhand power cable quickly rusts when exposed to the elements. Rust decays the galvanized steel armor, causing failure of decompression containment or mechanical protection to the underlying phases, such that the power cable cannot be reused. Conventionally, the shelf life of a gently used power cable is about three to six months.

One approach to extending the shelf life of power cables is to wrap the power cable in a sheet during storage in order to protect the cable from the elements. However, rudimentary wrapping has failed to significantly reduce degradation due to rust. Another approach has been to pull the cable through a rust inhibitor by unspooling the cable, pulling it through the rust inhibitor, and then respooling the cable onto a new reel. But unspooling the cable, pulling it, and respooling has proven difficult to implement and labor intensive. Since the cable is up to 12,000 feet long and nine tons heavy, the cable is difficult to handle, particularly once it is unwound off the reel. In addition, this unspooling process takes up a large amount of space.

Yet another approach has been to use a crane to submerge the cable in a pit full of rust inhibitor. This undesirably requires a large pit and a large quantity of rust inhibitor to cover 12,000 feet of cable—about 2,500 gallons of rust inhibitor—and much of the rust inhibitor is spilled or wasted in the process. Furthermore, overhead cranes are expensive and often not readily available, and submerging a spooled cable often fails to coat the entire cable, since air bubbles become trapped in the cable string and prevent the rust inhibitor from being applied to those areas.

As is apparent from the above, current ESP power cables are not adequately protected from degradation due to rust, and current attempts to apply rust inhibitors to ESP cables are expensive, wasteful and difficult to implement. Therefore, there is a need for an apparatus, system and method for treatment of ESP power cables to improve the shelf life of the cables and the feasibility of rust treatment techniques.

BRIEF SUMMARY OF THE INVENTION

One or more embodiments of the invention enable an apparatus, system and method for treatment of an electric submersible pump (ESP) power cable.

An apparatus, system and method for treatment of an ESP power cable is described. An illustrative embodiment of an ESP power cable treatment system includes a reel including a tubular drum having an aperture extending between an inner surface of the tubular drum and an outer surface of the tubular drum, the tubular drum including a pair of open flanged ends, each opening of the flanged ends fluidly coupled to the inner surface of the tubular drum, and a spoke extending across each of the openings and defining a central hub, an ESP power cable windingly wrapped around the outer surface of the tubular drum to form a cable-wrapped reel, a rotatable horizontal shaft extending longitudinally through the central hub, the reel removeably secured to the rotatable horizontal shaft such that the reel rotates with the horizontal shaft when secured, each end of the horizontal shaft supportively suspended above a tank by a pair of support members, the tank including a treatment fluid, the pair of support members actuatable between: a lowered position, wherein a lower portion of the cable-wrapped reel extends into and cycles through the treatment fluid when in the lowered position, and wherein the treatment fluid flows to the inner surface of the tubular drum in the lowered position, and a raised position, wherein the lower portion of the cable-wrapped reel is above a surface of the treatment fluid in the raised position. In some embodiments, the cable wrapped reel is rotatable within the tank such that in the lowered position a particular portion of the ESP power cable reel passes through the treatment fluid in the tank as the reel rotates and the particular portion becomes a bottom portion. In certain embodiments, all portions of the ESP power cable become the particular portion in succession as the reel rotates. In some embodiments, the aperture and openings define a treatment fluid pathway that flows from the tank into one of the openings, along the inner surface of the tubular drum and through the aperture to reach an inner layer of the ESP power cable. In certain embodiments, a series of vents extend through flanges of the pair of flanged ends. In certain embodiments, the series of vents define a treatment fluid pathway from the tank, through the vents and to layers of the ESP power cable. In some embodiments, the flanged of each flanged end of the pair of flanged ends includes an undulated surface. In some embodiments, the pair of support members telescope to move between the lowered position and the raised position. In certain embodiments, the ESP power cable is between 4,000 and 12,000 feet long and includes three insulated copper conductors that are enclosed by a helically wrapped strip of galvanized steel armor. In some embodiments, the cable-wrapped reel is rotatable by a bull gear drive coupled to the horizontal shaft. In certain embodiments, the ESP power cable treatment system further includes a hydraulic power unit operatively coupled to the pair of support members and the bull gear drive. In some embodiments, the bull gear drive includes a bull gear, the bull gear including a clevis fastener, the clevis fastener removeably secured to one of the spokes. In certain embodiments, the ESP power cable treatment system includes a pair of cradles, each cradle of the pair of cradles seating one side of the horizontal shaft.

An illustrative embodiment of a method of treating an ESP power cable includes wrapping an ESP power cable around a reel as the ESP power cable is removed from a production well to form ESP power cable layers, supporting the ESP power cable-wrapped reel horizontally above a tank, the reel supported on a shaft extending between a pair of actuatable support members, pumping treatment fluid into the tank, lowering the ESP power cable-wrapped reel partially into the tank by activating the actuatable support members such that a lower portion of the ESP power cable reel is submerged in the treatment fluid and an inner diameter of the ESP power cable-wrapped reel is fluidly coupled to the treatment fluid in the tank, and rotating the ESP power cable reel around its central axis such that each circumferential portion of an outermost layer of the ESP power cable layers is submerged in the treatment fluid at least once to coat the ESP power cable. In some embodiments, the treatment fluid is one of rust remover or rust inhibitor. In certain embodiments, the treatment fluid is first rust remover, the rust remover is drained from the tank, and then the pumping, lowering and rotating are repeated with rust inhibitor as the treatment fluid. In some embodiments the method further includes lifting the coated ESP power cable out of the tank by reactivating the actuatable support members, and draining the treatment fluid from the tank to a treatment fluid storage container. In certain embodiments, coating the ESP power cable includes successively and repeatedly submerging each circumferential portion of the outermost layer of the ESP power cable in the treatment fluid. In certain embodiments, the method further includes exposing an innermost layer of the ESP power cable layers to the treatment fluid through an aperture in the reel. In some embodiments, the ESP power cable reel is rotated by a bull gear drive. In some embodiments, the method further includes locking an end of the shaft into a cradle coupled to one of the support members of the pair of support members with a locking bar. In some embodiments, the method includes straightening flanges of the reel before supporting the ESP power cable-wrapped reel above the tank. In certain embodiments, the method includes storing the coated ESP power cable for a period of time on the reel, and deploying the ESP power cable into a second production well by unwinding it from the reel.

An illustrative embodiment of an electric submersible pump (ESP) power cable treatment apparatus includes an ESP power cable windingly wrapped around an ESP power cable deployment reel, the reel removeably attached to a dip tank, rotatable about a central axis of the reel and lowerable into the dip tank, and wherein a lower portion of the reel with ESP cable windings submerges into a rust treatment fluid in the dip tank as the reel rotates.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of illustrative embodiments of the invention will be more apparent from the following more particular description thereof, presented in conjunction with the following drawings wherein.

Figure 1:
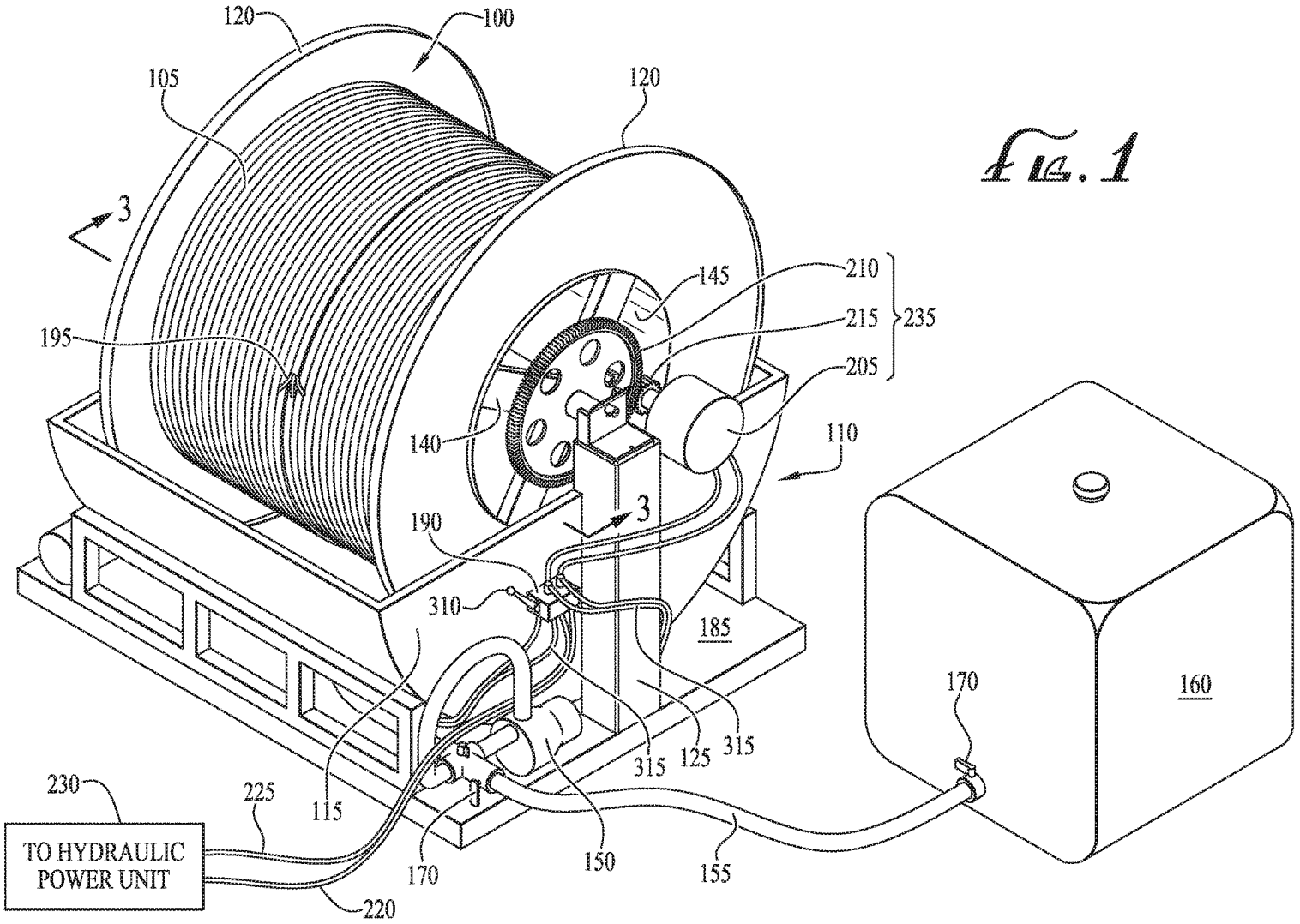
FIG. 1 is a perspective view of a dip tank system of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives to such embodiments that fall within the scope of the present invention as defined by the appended claims.

DETAILED DESCRIPTION

An apparatus, system and method for treatment of an electric submersible pump (ESP) power cable will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a support member includes one or more support members.

"Coupled" refers to either a direct connection or an indirect connection (e.g., at least one intervening connection) between one or more objects or components. The phrase "directly attached" means a direct connection between objects or components.

As used herein, the term "outer" or "outward" means the radial direction away from the center of a reel. In the art, "outer diameter" (OD) and "outer circumference" are sometimes used equivalently. As used herein, the outer diameter is used to describe what might otherwise be called the outer circumference or outer surface of a component such as tubular drum of a reel.

As used herein, the term "inner' or "inward" means the radial direction towards the center of the reel. In the art, "inner diameter" (ID) and "inner circumference" are sometimes used equivalently. As used herein, the inner diameter is used to describe what might otherwise be called the inner circumference or inner surface of a component such as a tubular drum of a reel.

As used herein, the term "dip tank" means a container holding a substance that is used for dipping or coating. An object may be immersed (or partially immersed) in a dip tank or it may be suspended over a vapor wafting from the tank.

For ease of description and so as not to obscure the invention, illustrative embodiments are described in terms of an ESP power cable being treated with a rust remover or rust inhibitor. However, illustrative embodiments are not so limited and may be employed where it is desirable to coat any cable, wire, hose, spool, reel or flexible pipe with any fluid or powder substance. In one example, the treatment fluid may be washing fluid. In another example, the treatment fluid may be water and used as a grounding plane.

Illustrative embodiments provide a system for treating an ESP power cable with a rust remover, rust inhibitor or both. Illustrative embodiments may provide an efficient method of coating an ESP power cable with rust treatment fluid, increasing the shelf life of used ESP power cables from the conventional untreated time frame of three to six months, instead to one year, three years or more. Illustrative embodiments allow improved handling of power cables that are heavy and long, such as up to about 9 tons in weight and up to about 12,000 feet in length, and at the same time require 15% or less by volume of the treatment fluid required—reducing the conventionally required 2,500 gallons to instead about 330 gallons. Illustrative embodiments may eliminate the need for an overhead crane and decrease spillage and waste of treatment fluid as compared to full submersion treatment methods. Illustrative embodiments may also reduce or eliminate air pockets between the layers of cable that may otherwise prevent coating of those areas. Illustrative embodiments may provide flexibility of use for any type of treatment fluid and be modified to fit any size of steel cable reel, may be employed in close quarters and may minimize waste of treatment fluid.

Illustrative embodiments provide a dip tank for an ESP power cable reel, which reel includes an ESP power cable wrapped on the reel. The reel may include about two to twenty layers of cable, depending on the length of the cable and the size of the reel. The dip tank may include a shallow basin containing rust treatment fluid such as a rust remover or rust inhibitor. The ESP power cable reel may be suspended horizontally on a shaft above the dip tank, and may be raised and lowered with respect to the basin. In illustrative embodiments, when lowered into the basin only the lower third portion of the ESP power cable reel may be immersed in the treatment fluid. In illustrative embodiments, the treatment fluid may cover just enough of the reel to allow fluid to reach the inner surface of the reel, and travel through an aperture in the reel barrel to reach the innermost layer of wrapped power cable. This positioning may allow both the ID and the OD of the power cable layers to be exposed to treatment fluid.

When lowered into the basin, the ESP power cable reel may be rotated such that each portion of the reel is successively dipped into the treatment fluid as it reaches the bottom of the rotation cycle, and then removed from the treatment fluid as it turns towards the top of the rotation cycle. The ESP power cable reel may be rotated once (one 360° cycle), more than once, or for about one to four hours at about five rotations per minute (rpm), to permit the entire ESP power cable to be coated with treatment fluid. Rotation of the reel may also cause any air bubbles between the layers of cable to be displaced or moved such that the entire cable may be coated without any untreated pockets. Once the ESP power cable is sufficiently coated, the reel may be actuated upwards above the basin to dry, where the basin may catch any drippings. Treatment fluid may be pumped in and out of the basin with a fluid transfer pump and hoses attached to the dip tank. A bull gear drive, tire drive, chain and sprocket, belt and pulley, spray nozzle and/or other rotation mechanism known to those of skill in the art may cause rotation of the reel during treatment and/or apply treatment fluid to the power cable. A control panel may allow operation of the dip tank.

FIG. 1 shows a dip tank system of an illustrative embodiment. As shown in FIG. 1, reel 100 includes ESP power cable 105 wrapped around reel 100 in layers of wrapped power cable 105. ESP power cable 105 may be a previously used (secondhand) cable between 4,000 and 12,000 feet long and be wrapped around reel 100 in two to twenty layers of cable 105, for example. ESP power cable 105 may be up to about nine tons in weight, depending on the length of ESP power cable 105, and include galvanized steel armor strip 20-34 mils in thickness, with three insulated copper conductors inside the armor. In FIG. 1, cable phase ends 195 of power cable 105 with three insulated copper conductors are shown.

Figure 11B:
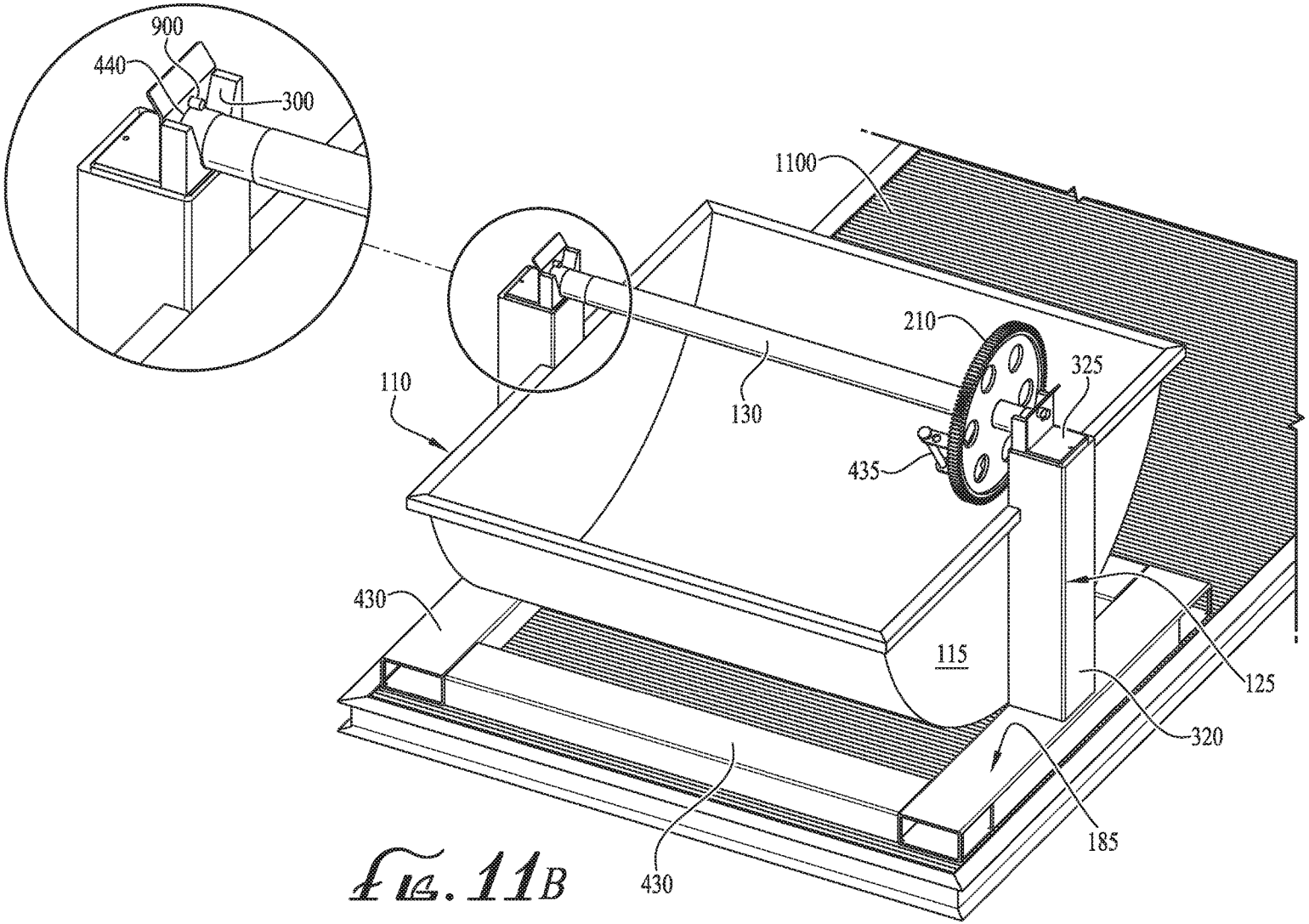
Figure 12:
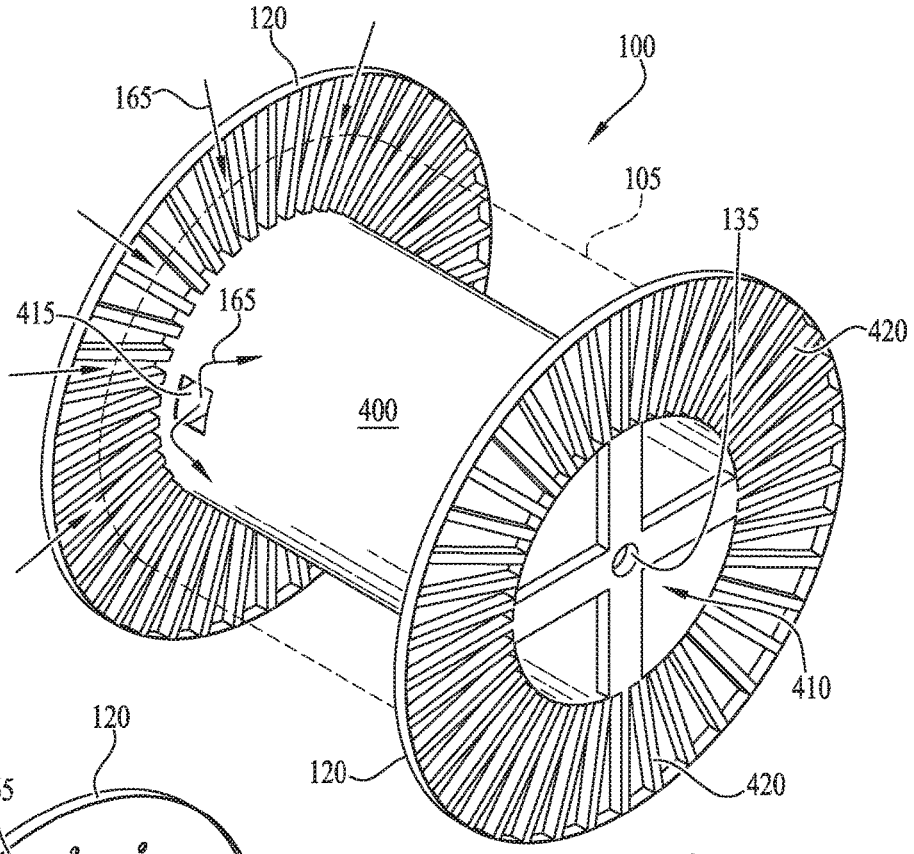
FIG. 12 is a perspective view of a reel of an illustrative embodiment.
Figure 13:
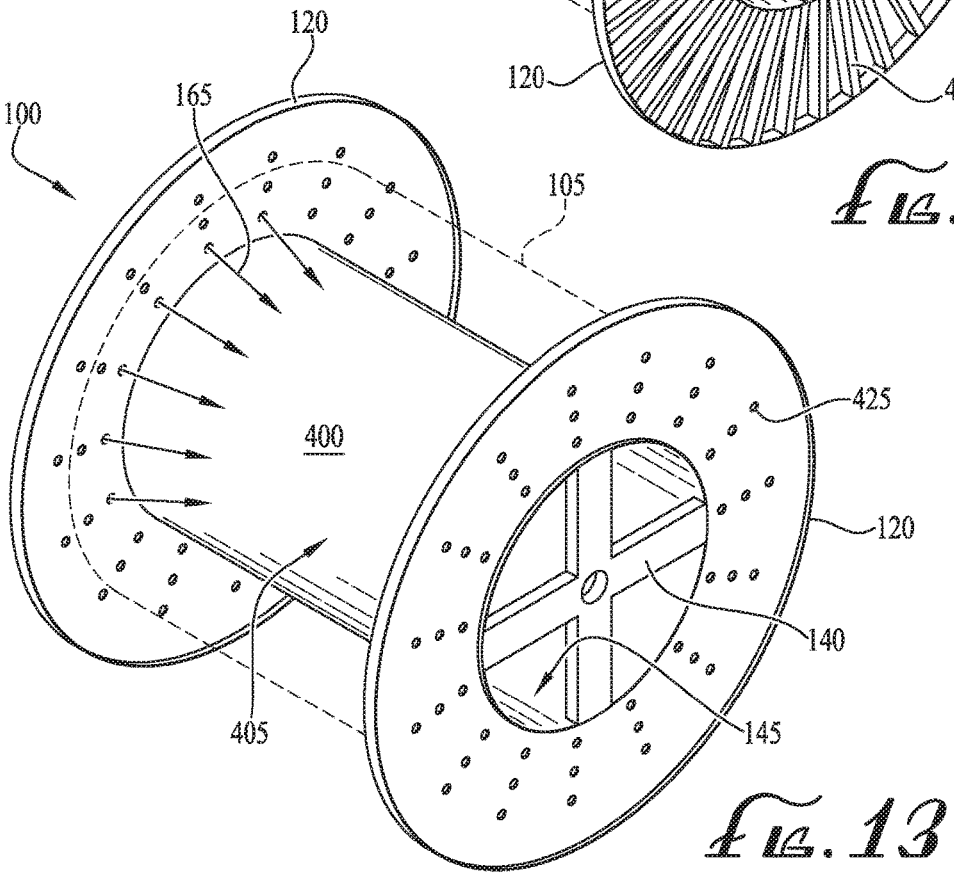
FIG. 13 is a perspective view of a reel of an illustrative embodiment.

A reel of illustrative embodiments is shown in FIG. 12 and FIG. 13. Reel 100 may be a seventy-eight inch diameter reel, ninety-six inch diameter reel or another similar sized reel used to store, deploy and/or transport ESP power cables. Reel 100 may include tubular drum 400 with flange 120 at each end of drum 400. Drum 400 may be hollow and include inner surface 145 and outer surface 405. When reel 100 holds power cable 105, power cable 105 may wrap in layers around outer surface 405 of drum 400. Flanges 120 may be annular discs with central openings 410 such that the ends of drum 400 are open. One or more spokes 140 may extend across openings 410 and define central hub 135 of reel 100. Shaft 130 (shown in FIG. 11B) may extend through hub 135 when reel 100 is suspended on, in and/or above dip tank 110. Drum 400 may include one or more apertures 415. During fluid treatment procedures, treatment fluid 165 may enter openings 410 on drum 400 ends and travel from inner surface 145 to outer surface 405 through apertures 415, in order to reach inner layers of power cable 105 wrapped around drum 400. Flange 120 may include undulations 420 to assist in guiding treatment fluid 165 to flow into openings 410 and/or aperture 415. As shown in FIG. 13, flange 120 may include vents 425, which may be holes drilled into flanges 120. Vents 425 may allow treatment fluid 165 to flow through flanges 120 to reach inner layers of power cable 105, when power cable 105 is wrapped around drum 400. If flanges 120 are severely bent, they should be straightened prior to mounting reel 100 onto dip tank 110. ESP power cable 105 may be initially wrapped around reel 100 as ESP power cable 105 is pulled out of a well or other deployment site, and then transported to the treatment site with a fork lift, truck and/or other transport vehicle. Any chunks of dirt, gravel or other contaminants should be removed from ESP power cable 105 prior to treatment.

Figure 11A:
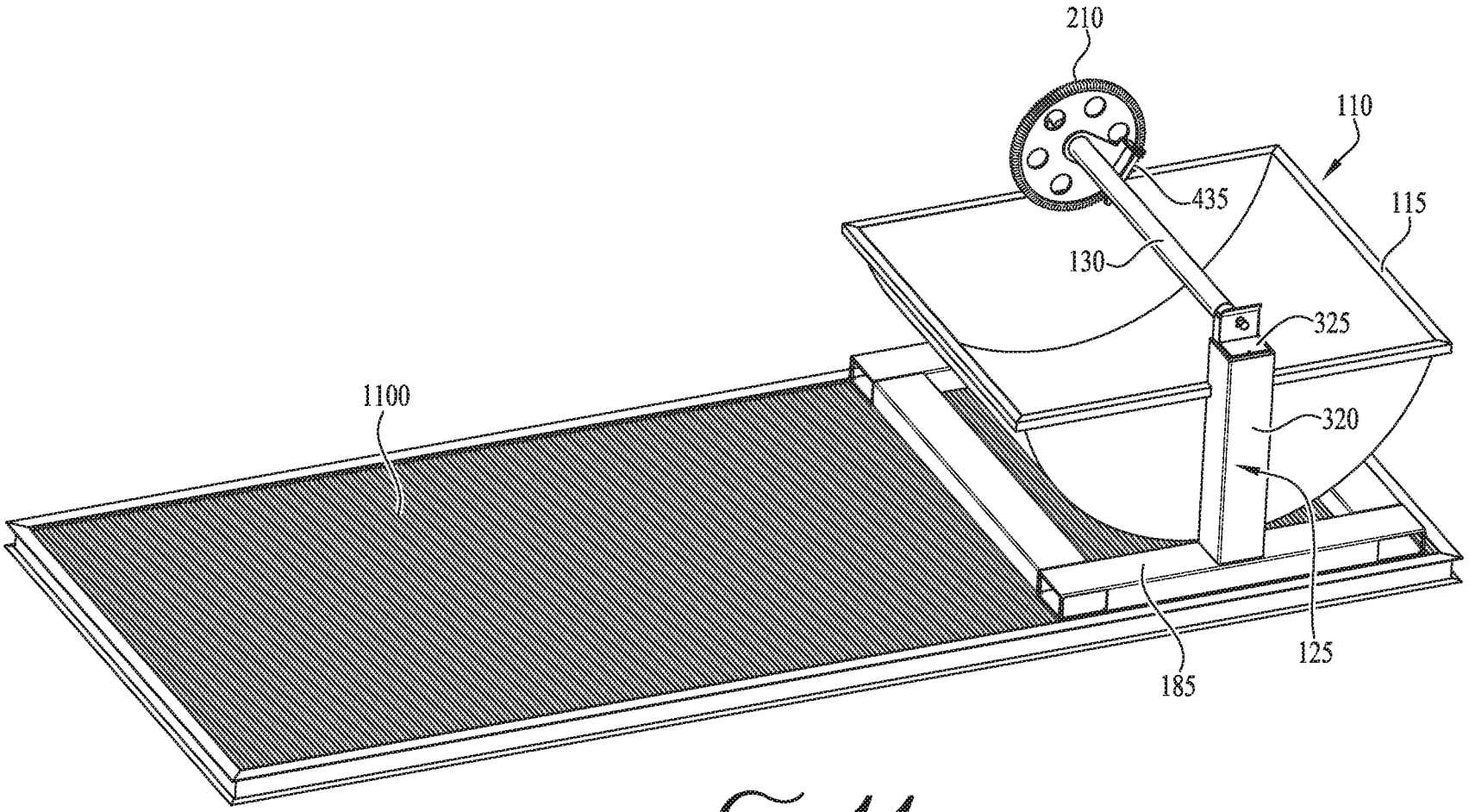
FIGS. 11A-11B are perspective views of a dip tank of an illustrative embodiment.

FIG. 11A and FIG. 11B illustrate a dip tank of an illustrative embodiment. Shaft 130 may extend longitudinally through central hub 135 of reel 100 to suspend reel 100 with ESP power cable 105 above basin 115 of dip tank 110. Shaft 130 and reel 100 with ESP power cable 105 may be supported above basin 115 of dip tank 110 with support members 125 that hold, support and/or cradle shaft 130 at and/or proximate both ends of shaft 130. Dip tank 110 may include basin 115, which basin 115 may be a container for treatment fluid 165 and/or a treatment substance. Basin 115 may be secured on base 185. Basin 115 may be semi-circular or semi-cylindrical in shape. Basin 115 having semi-circular or semi-cylindrical shape may provide the most efficient coverage around reel 100 while minimizing the amount of treatment fluid needed. A square or rectangular basin 115 may also be used. Basin 115 may be capable of holding about four-hundred-fifty gallons of fluid, although in certain illustrative embodiments, basin 115 will not be filled to capacity. Base 185 may shaped to provide a platform to support basin 115 and/or to allow a fork lift to pick up drip tank 110. In the example shown in FIGS. 11A and 11B, base 185 is shown rectangular in shape and comprised of rectangular tubes 430. In the example shown in FIG. 1, Base 185 is a rectangular platform. Base 185 may include wheels so that dip tank 110 may be easily moved without the need for a fork lift. Base 185 may catch drips and debris that may fall off reel 100 and/or ESP power cable 105. Additional containment for spill management may be included on dip tank 110 if desired for safety concerns. FIG. 11A and FIG. 11B illustrate an exemplary spill management system in the form of spill tray 1100. Fluid collected by spill tray 1100 may be recovered and recycled, for example using fluid transfer pump 150 and supply container 160.

Returning to FIG. 1, treatment fluid 165 may be pumped into basin 115 with fluid transfer pump 150. Tubing 155 may connect basin 115 to supply container 160, which may contain treatment fluid 165. Treatment fluid 165 may be rust remover, rust inhibitor, cable washing fluid, water or another coating fluid desired to be used with ESP power cable 105. Where treatment fluid 165 is water, dip tank 110 may be employed to wet ESP power cable 105, and then the water in basin 115 may be used as a grounding plane. Rust inhibitor may be an oil-based rust inhibitor. A suitable rust inhibitor for ESP power cable 105 is available from Tulco Oils, Inc. of Tulsa, Okla. or Summit ESP, LLC of Tulsa, Okla. Rust remover may be a water-based rust remover and/or iron oxide dissolving chemical. If the ambient temperature is cold, such as around 15° F., treatment fluid 165 should be brought indoors in advance of use with dip tank 110 in order to lower the viscosity for ease of pumping and application. Fluid transfer pump 150 may operate in conjunction with transfer valves 170 that control the flow of treatment fluid 165 into or out of basin 115. In one example, transfer valves 170 may include a four-way valve that may be rotated into a "fill" position or an "evacuation" position. The "fill" position may extend from transfer pump 150 to dip tank 110. Transfer valves 170 may also include a spill containment valve on the input of transfer pump 150, and a tote valve with vent. Transfer valves 170 may be manually operated and/or operated by control panel 200 (shown in FIG. 2).

Figure 2:
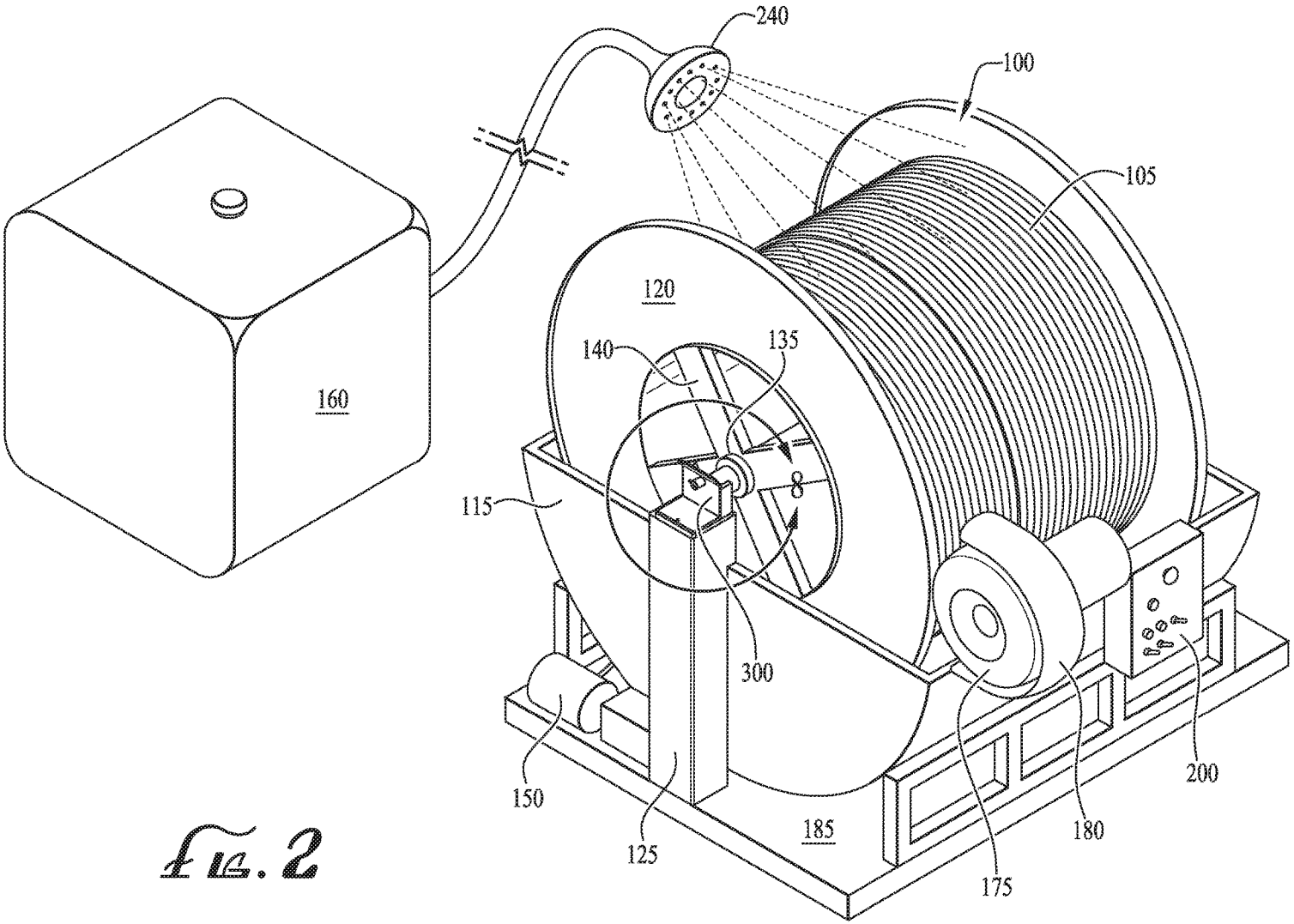
FIG. 2 is a perspective view of a dip tank of an illustrative embodiment loaded with a cable-wrapped reel.

FIG. 2 illustrates dip tank 110 of an illustrative embodiment loaded with reel 105. As shown in FIG. 2, control of power to dip tank 110, operation of support members 125, operation of fluid transfer pump 150, operation of bull gear drive 205 and/or operation of spin of tire drive 175 may be controlled by an operator using control panel 200. In some embodiments, control panel 200 may be wired to dip tank 110, may be a remote control, or may be an application on a mobile device such as a smart phone.

Figure 3:
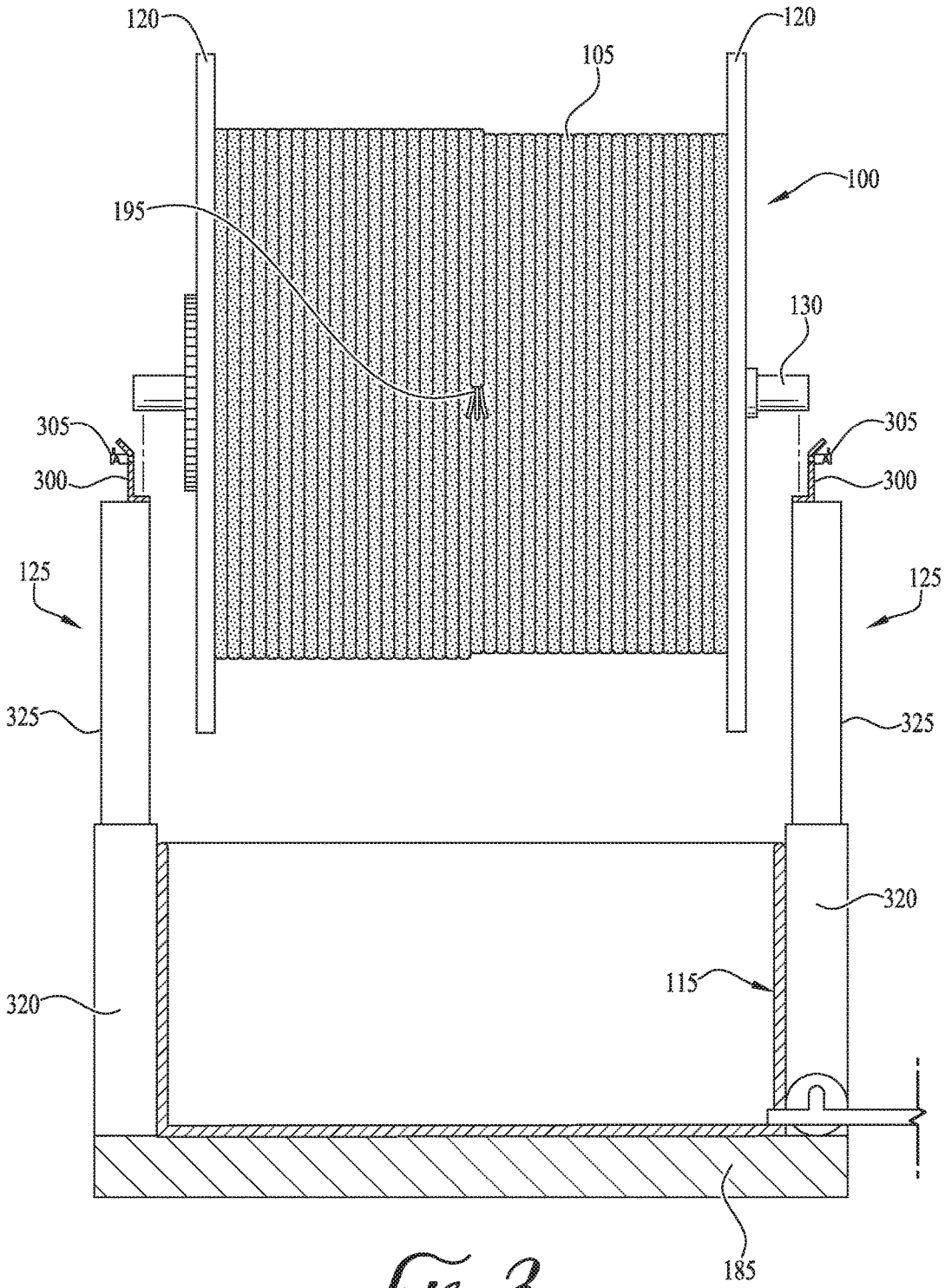
FIG. 3 is a perspective view of a reel with cable being loaded onto support members of a dip tank of an illustrative embodiment.
Figure 4:
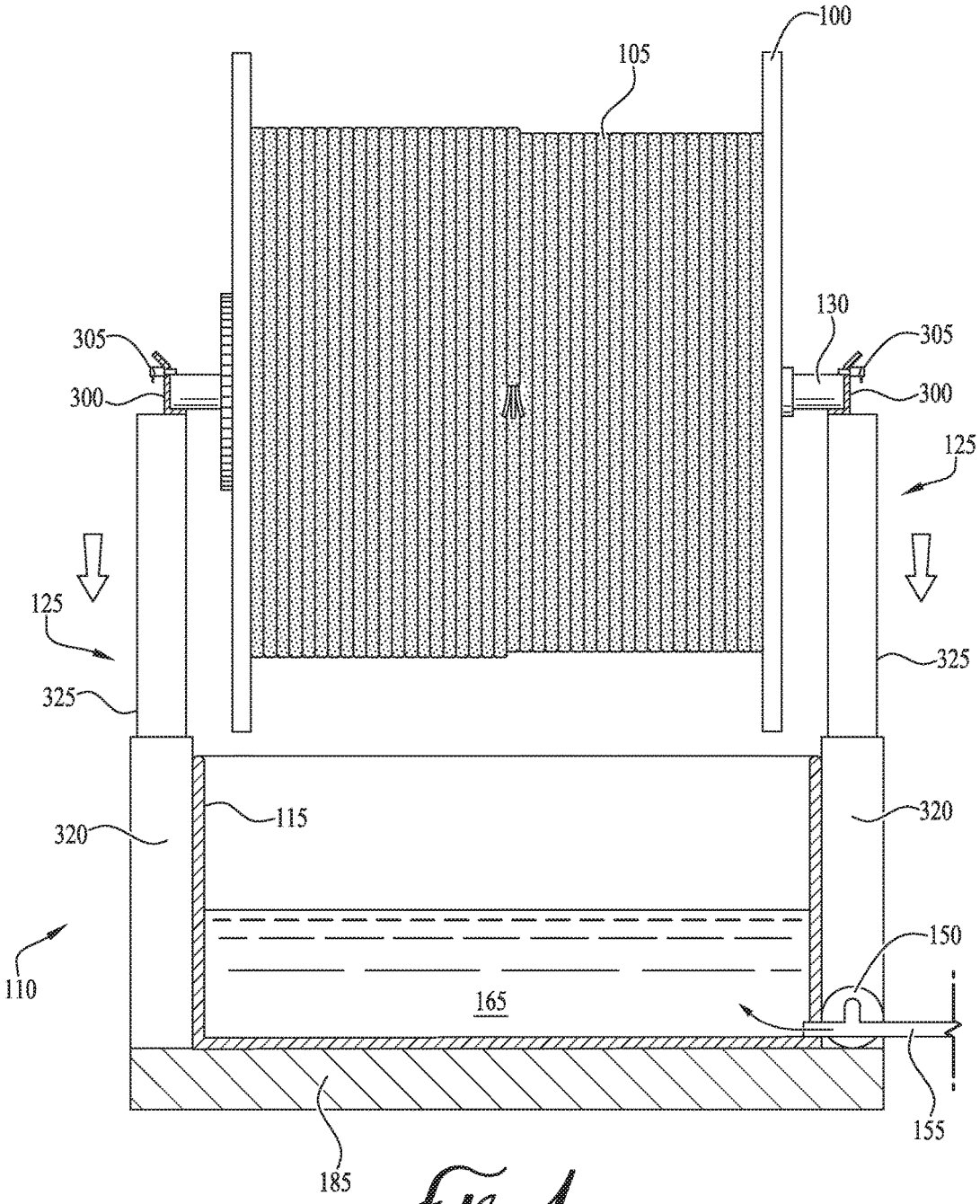
FIG. 4 is a perspective view of an illustrative embodiment of a reel being lowered into a treatment fluid of a dip tank of an illustrative embodiment.

FIG. 3 illustrates placement of reel 105, with shaft 130 extending centrally through hub 135 of reel 105, loaded onto dip tank 110. Cradles 300 may be placed at the top of each support member 125. Ends of shaft 130 may be placed into cradles 300. Cradles 300 may include cradle locks 305 that may be engaged once shaft 130 is in place. Cradle locks 305 may keep shaft 130 securely within cradles 300 during operation of dip tank 110, while still allowing shaft 130 to rotate within cradles 300. FIG. 4 illustrates shaft 130 locked into cradles 300. In some embodiments, only one side of dip tank 110 (or one support member 125) may include cradle lock 305. In embodiments having only a single-sided cradle lock 305, the straighter flange 120 should be placed on the side having cradle lock 305.

Figure 8:
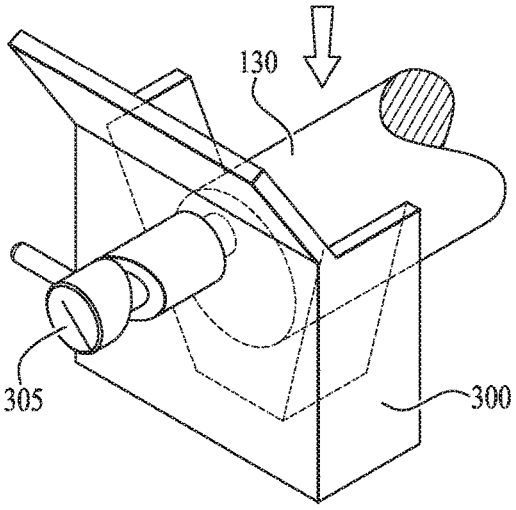
FIG. 8 is an enlarged view of the shaft cradle of FIG. 2 in an unlocked position of an illustrative embodiment.
Figure 9:
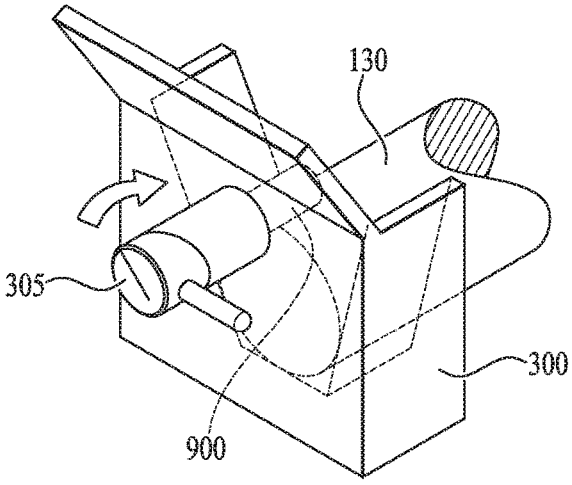
FIG. 9 is a perspective view of a shaft cradle of an illustrative embodiment in a locked position.

FIG. 8 and FIG. 9 illustrate an exemplary cradle 300 of an illustrative embodiment. As shown in FIG. 8, an end of shaft 130 may be placed into cradle 300 when cradle lock 305 is in an unlocked position. Cradle 300 may include a recession or socket with tapered walls, such that the cradle recession becomes smaller towards the bottom of cradle 300. Cradle lock 305 may include a locking bar 900 that extends over shaft 130 as cradle lock 305 is rotated into a locked position. Rotation of cradle lock 305 may cause locking bar 900 to slide towards and/or over shaft 130. Locking bar 900 may extend over the top of shaft 130 and press downward on or entrap shaft 130 end, keeping shaft securely in cradle 300, even as shaft 130 may spin with reel 100. FIG. 8 illustrates cradle lock 305 in an unlocked position. FIG. 9 illustrates cradle lock 305 in a locked position.

Returning to FIG. 4, once shaft 130 is locked into place, support members 125 may actuate downwards towards basin 115, lowering reel 100 and/or ESP power cable 105 partially into treatment fluid 165. Support members 125 may be hydraulically, pneumatically or mechanically actuated. In hydraulic or pneumatic embodiments, control panel 200 may include a power switch for ram 190 (shown in FIG. 1), which ram 190 may be a hydraulic or pneumatic (air) pump. As shown in FIG. 1, support members 125 may be powered hydraulically using hydraulic power unit 230. Selector valve 310 may be operated by a lever and may be employed to raise and lower support members 125, which in turn may raise and lower reel 100. Ram 190 may pump air or hydraulic fluid through fluid hoses 315 in response to the opening and closing of selector valve 310, and the pressure created or removed may raise and lower support members 125. Support members 125 may be tubes, bars, beams and/or pipes of any shape, such as cylindrical, square or round, and may include concentric parts that telescope. As shown in FIG. 4, upper telescoping member 325 may slide into lower telescoping member 320 as ram 190 actuates reel 100 downwards towards basin 115. Also as shown in FIG. 4, treatment fluid 165 may be pumped into basin 115 with fluid transfer pump 150 and tubing 155. In illustrative embodiments, about three-hundred-thirty gallons, or between three-hundred gallons and four-hundred gallons of treatment fluid 165 may be pumped into basin 115 of dip tank 110, depending on the size of reel 100, ESP power cable 105 and/or basin 115.

Figure 5:
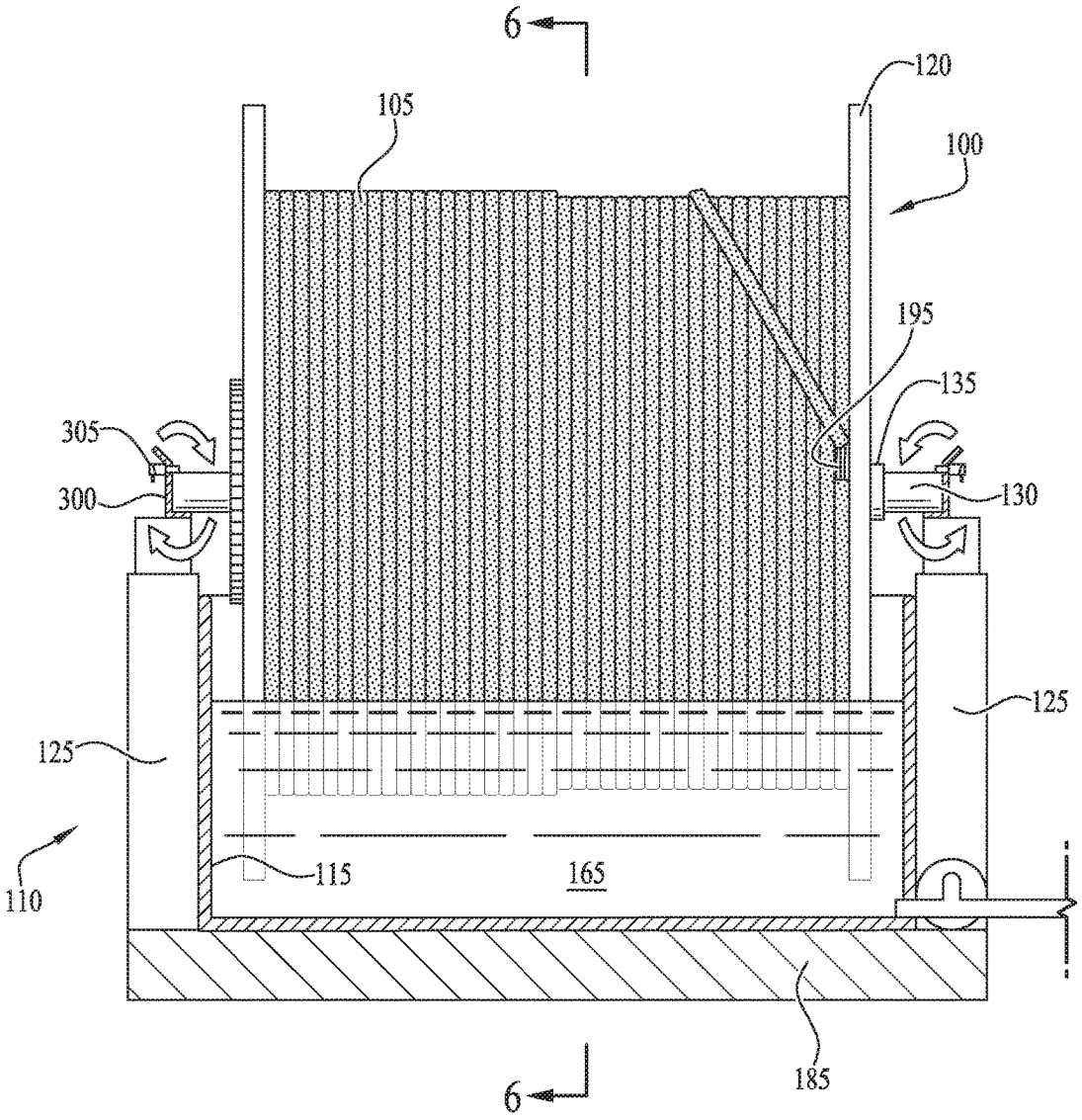
FIG. 5 is a perspective view of a reel rotating on a dip tank of an illustrative embodiment.
Figure 6:
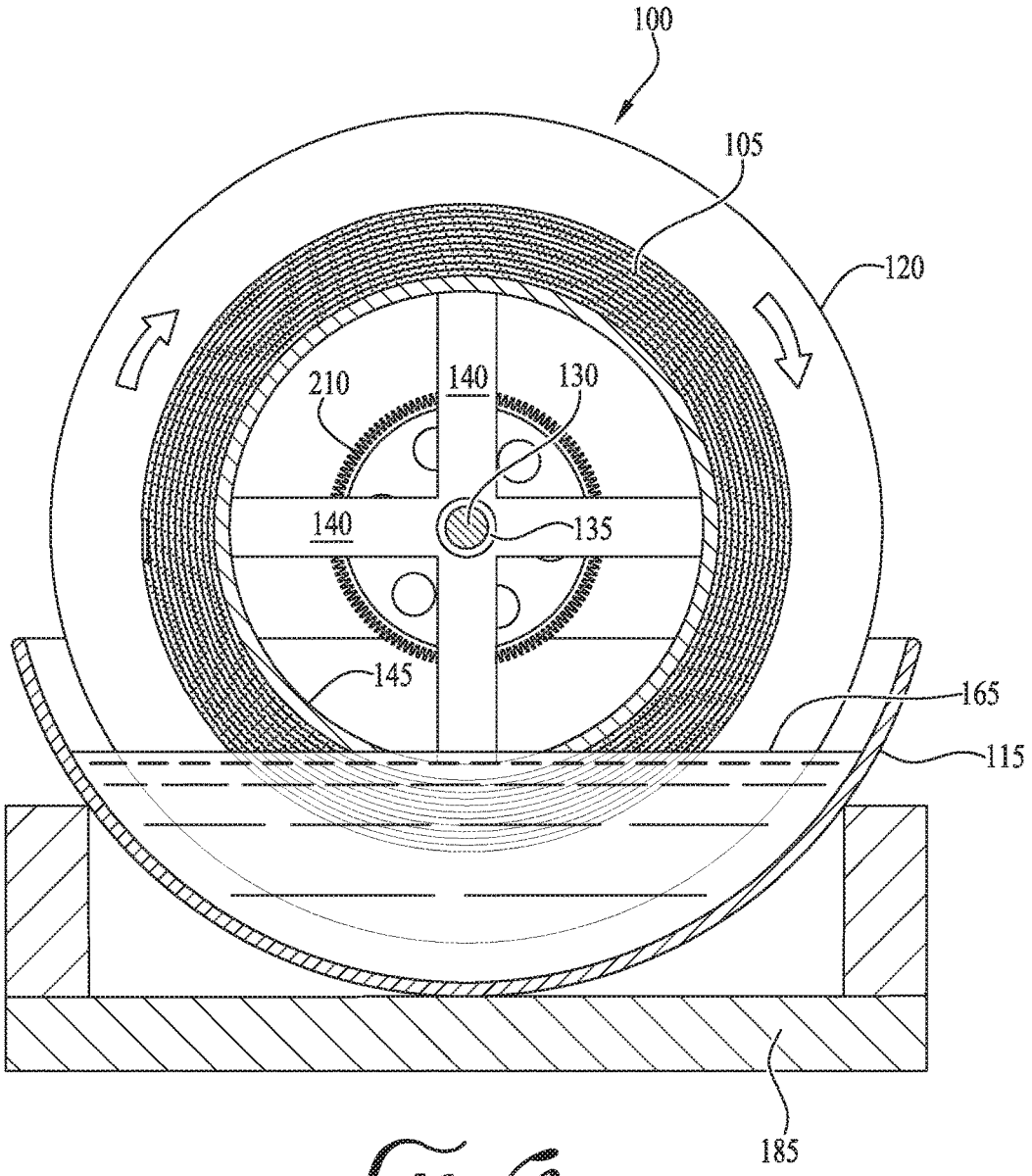
FIG. 6 is a cross-sectional view across line 6-6 of FIG. 5 of a reel cycling through treatment fluid on a dip tank of an illustrative embodiment.

FIG. 5 illustrates reel 100 partially lowered into basin 115 of dip tank 110. As shown in FIG. 5, when upper telescoping member 325 is collapsed and/or retracted into lower telescoping member 320 in the lowered position, reel 100 and/or ESP power cable 105 is only partially submerged in treatment fluid 165. FIG. 6 further illustrates the positioning of reel 100 when in a lowered position, with respect to the level of treatment fluid 165 in basin 115. As shown in FIG. 6, the level of treatment fluid 165 may be just deep enough to enter openings 410 (shown in FIG. 12) and flow to drum inner surface 145 at the bottom of reel 100 (six o'clock position). For example at the six o'clock position drum inner surface 145 may be covered by a quarter inch, half inch, one inch or a few inches of treatment fluid 165. In illustrative embodiments, treatment fluid 165 may immerse about one-third of reel 100 (by height or volume) and/or basin 115 may contain a depth of treatment fluid 165 of about one to two feet. An exemplary basin 115 may be about sixty-eight inches long and/or hold about four-hundred-fifty gallons of fluid when at full capacity. In a four-hundred-fifty gallon basin, about three-hundred-thirty gallons of treatment fluid 165 may be used to reach the appropriate level of fluid once reel 100 is lowered into treatment fluid 165. Fluid displacement caused by reel 100 should be taken into consideration when filling basin 115. FIG. 6 also illustrates a basin 115 rounded and/or semi-circular in shape, to match the curvature of reel 100, supported on base 185.

Once reel 100 has been lowered into basin 115 and partially submerged in treatment fluid 165, ram 190 may be switched off and/or selector valve 310 may be switched to divert controlled flow coming from facility hydraulic power unit 230 to hydraulic gear motor 205, and then reel 100 may be rotated in a fashion similar to a rotisserie. Prior to rotation, cable phase ends 195 may be sealed to the lead jacket with clear fluorinated ethylene propylene (FEP) and/or polyimide splice tape. Cable phase ends 195 may be affixed to flange 120, such as with an eye bolt or U bolt, to secure cable phase ends during rotation of reel 100. In this fashion, cable phase ends 195 may be kept from coming loose during rotation, and sealed to prevent treatment fluid 165 from migrating up under the lead jacket of insulation.

In some embodiments, reel 100 may be rotated 360° about its central axis. As shown in FIG. 1, bull gear drive 235 may include bull gear motor 205 that drives bull gear 210 to rotate reel 100. The inventors have observed that bull gear drive 235 may be employed to rotate reel 100 despite varying reel 100 conditions. Some types of drives, such as tire drive 175, may not be effective under conditions where flanges 120 are bent. On some occasions, flanges 120 may develop flat spots which may cause the tire of tire drive 175 to lose traction, whereas bull gear drive 235 may not suffer from this drawback. Bull gear drive 235 may include bull gear 210 and pinion 215. Bull gear drive 235 may be powered hydraulically using hydraulic power unit 230 in the power cable treatment facility that may be the same hydraulic power unit used for spooling power cable 105 during the cable repair or inspection process and/or the hydraulic power unit used to raise and lower support members 125. Bull gear drive 235 may be tied into hydraulic power unit 230 with supply hose 220 and return hose 225. Selector valve 310 mounted on dip tank 110 may be a dual selector that diverts controlled flow coming from facility hydraulic power unit 230 to either the vertically oriented support member 125 cylinders, or to hydraulic gear motor 205 that drives bull gear 210, depending on the position of selector valve 310.

Returning to FIG. 11B, bull gear 210 may be secured to shaft 110 for example by bolt or screw, such that shaft 110 rotates with bull gear 210. Bearing 440 on each end of shaft 110 may aid in rotation of shaft 110. Bull gear 210 may include clevis fastener 435. Clevis fastener 435 may be a c-shaped connector that removeably secures around one spoke 140 of reel 100, attaching reel 100 to bull gear 210 such that reel 100 rotates with shaft 110 and/or bull gear 210. Other detachable fastening means, such as a clamp, shackle and/or hook may be employed to removeably secure reel 100 to bull gear 210 to permit reel 100 to rotate with bull gear 210 and/or shaft 110. In some embodiments, shaft 110 may not rotate and reel 100 and/or bull gear 210 may rotate around a stationary shaft 110.

In certain embodiments, a tire drive may be used to rotate reel 100 by friction. When a tire drive is used, care should be taken to ensure flanges 120 are not bent to improve effectiveness of tire drive 175 rotation. FIG. 2 illustrates an embodiment employing an exemplary tire drive. Tire drive 175 may be pressed up against ESP power cable 105, which is wrapped around reel 100. The position of tire drive 175 may be adjustable to accommodate different sizes of reels 100 and/or ESP power cables 105, and also to permit actuation of support members 125 while reel 100 is attached. For tire drive 175 to operate properly, care should be taken to ensure the outer layer of ESP power cable 105 is spooled tightly and evenly to maximize contact with tire drive 175, keep reel 100 in balance and allow for even exertion of force. In tire drive 175 embodiments, shroud 180 may cover tire drive 175 to prevent splashing and/or loss of treatment fluid 165 as the treatment fluid is picked up by tire drive 175 through contact with ESP power cable 105. In some embodiments, tire drive 175 may be engaged with a wingnut (not shown) on the tire drive 175 upright support. Tire drive 175 may be turned by an electric motor. In tire drive embodiments, ESP power cable 105 may be wrapped about reel 100 so that the outer layer of cable 105 is flat and rests evenly against tire drive 175.

Figure 10:
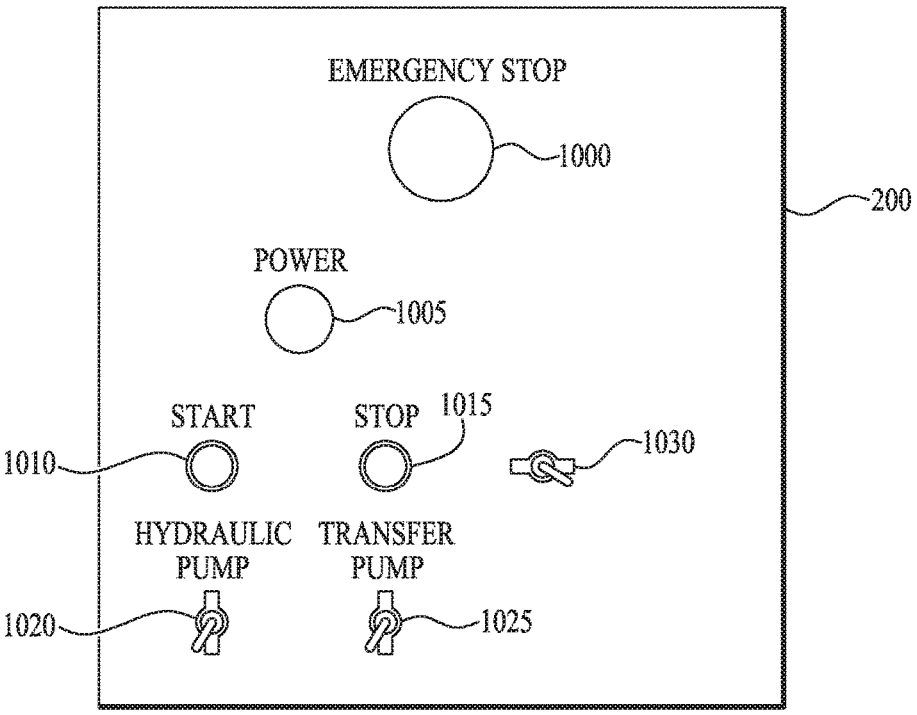
FIG. 10 is a schematic diagram of a control panel of an illustrative embodiment.

Tire drive 175 and/or bull gear drive 235 may be rotatable in both a clockwise and counter-clockwise direction, the rotation controlled by rotation switch 1030 (shown in FIG. 10). Tire drive 175 and/or bull gear drive 235 should be rotated such that reel 100 spins in the take-up direction. If reel 100 spins in the pay-off direction, tire drive 175 and/or bull gear drive 235 should be stopped and then rotation switch 1030 may be flipped to change the direction of rotation. Other types of rotation mechanisms may be employed rather than, or in addition to, tire drive 175 and/or bull gear drive 235. In instances where treatment fluid 165 is slippery, such as with an oil-based rust inhibitor, the rotation of tire drive 175 may become less effective as ESP power cable 105 is coated with the slippery substance and tire drive 175 also becomes coated by contact with ESP power cable 105. In such instances, bull gear drive 235, a chain and sprocket or belt and pulley may be employed to rotate reel 100. In some embodiments, spray nozzle 240 (shown in FIG. 2) may be employed from above reel 100 to coat reel 100 with treatment fluid 165.

As shown in FIG. 1 and FIG. 6, if motor 205 rotates pinion 215 in a counter-clockwise direction, bull gear 210 and reel 100 rotate in a clockwise direction, and vice versa. Tire drive 175 and/or bull gear drive 235 may be operated by control panel 200, which may for example include power switch 1005 and/or rotation switch 1030 for direction of rotation—clockwise or counterclockwise.

As reel 100 with wrapped power cable 105 rotates, the bottom portion of reel 100 moves in and out of treatment fluid 165, such that each portion of ESP power cable 105 may be submerged in succession. When bottom portion of reel 100 is submerged, the portion of ESP power cable 105 at the bottom of reel 100 may be submerged at least at the outer most layer of ESP power cable 105. Drum inner surface 145 may also be submerged at the bottom portion of reel 100, allowing treatment fluid 165 to reach the innermost layer of ESP power cable near drum inner surface 145 through aperture 415. Additionally, treatment fluid may enter vents 425, further exposing middle layers of power cable 105 to treatment fluid 165. In this manner ESP power cable 105 layers may be exposed to treatment fluid 165 from both sides, and then seep inwards from both the inside (proximate drum inner surface 145) and the outside to treat inner and outer layers of ESP power cable 105. Reel 100 may rotate at about five revolutions per minute (rpm), and be permitted to rotate for about one to four hours, or another period of time depending on the type of treatment fluid 165 employed and/or the thickness of coating required. In one example, reel 100 may only be rotated once (one 360° cycle), for example to wet ESP power cable 105 with water. In another example, reel 100 may be rotated at 5 rpm for two hours to coat ESP power cable 105 with a rust inhibitor. In this time period, each portion of ESP cable 105 may be repeatedly exposed to treatment fluid 165 while reel 100 continuously rotates. Where treatment fluid 165 is rust inhibitor, the rust inhibitor may coat ESP power cable 105. The rotation of reel 100 may prevent any air bubbles from blocking a portion of ESP power cable 105 from receiving a coating. As reel 100 rotates, treatment fluid 165 may drip from reel 100. Basin 115, base 185 and/or spill tray 1100 may catch drippings from reel 100 and/or power cable 105. Drops that are caught may be reused.

In addition to, or instead of, tire drive 175 and/or bull gear drive 235, another or alternative rotation means may be employed to rotate reel 100. In one example, a chain and sprocket or belt and pulley, which are well known to those of skill in the art, may be employed. Like bull gear drive 235, the belt and pulley or chain and sprocket may rotate reel 100 from spokes 140, hub 135 and/or the ends of shaft 130 rather than from the outer layer of ESP power cable 105 to prevent slipping. A spray nozzle 240 (shown in FIG. 2), that sprays treatment fluid 165 over the top of reel 100, may be employed in addition to, or instead of tire drive 175 and/or bull gear drive 235. In some embodiments, spray nozzle 240 may provide faster and/or a higher percentage of coverage of coating of treatment fluid 165.

Figure 7:
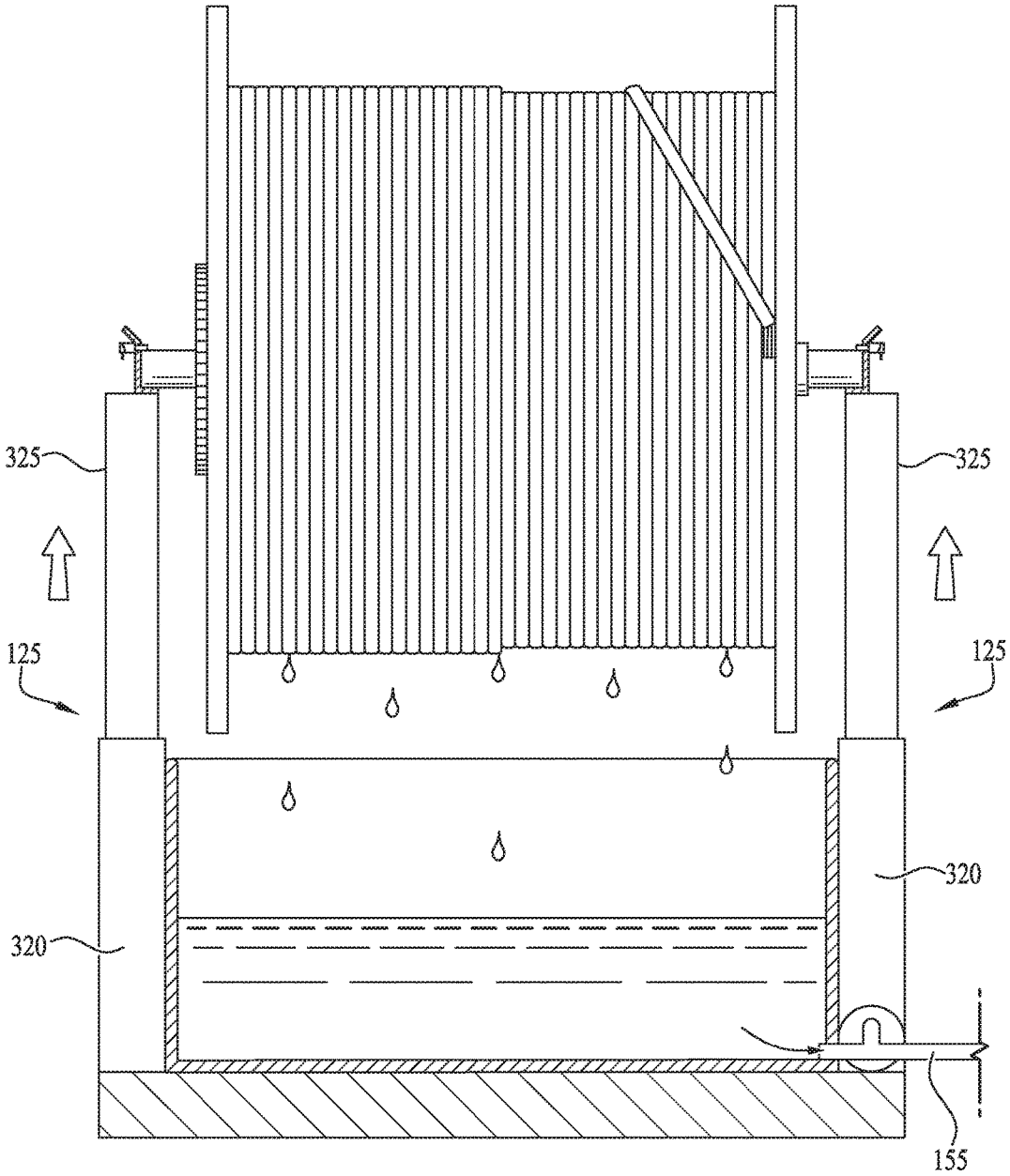
FIG. 7 is a perspective view of a dip tank of an illustrative embodiment in a raised position with a coated reel drying on the exemplary dip tank.

Once ESP power cable 105 is sufficiently coated with rust inhibitor, rust remover or other treatment fluid 165, support members 125 may be actuated and/or extended to a raised position, as shown in FIG. 7. As shown in FIG. 7, upper telescoping member 325 may slide out of lower telescoping member 320 and/or be lifted by ram 190 and/or hydraulic power unit 230. As support members 125 rise and/or extend, reel 100 with ESP power cable 105 may be lifted out of treatment fluid 165 and be permitted to dry in a raised position. As shown in FIG. 7, drippings of treatment fluid 165 that fall from reel 100 may be caught in basin 115, spill tray 1100 and/or base 185. This may minimize waste of treatment fluid 165 and allow drippings to be reused. Treatment fluid 165 may be drained from basin 115 with tubing 155, valves 170 and fluid transfer pump 150, and treatment fluid 165 may be returned to supply container 160. When reel 100 is dry (about 1 hour to dry, depending on the type of treatment fluid 165) and/or ready to be removed from dip tank 100, cradle locks 305 may be released, and reel 100 may be removed with a fork lift. Where treatment fluid 165 is a rust inhibitor, reel 100 with coated ESP power cable 105 may then be safely stored for up to one year or up to three years, for example, without being corroded by rust, and then reused in a downhole well to power an ESP assembly. Where treatment fluid 165 is a rust remover, the process may be repeated using a rust inhibitor using the same dip tank 110 system. A benefit of illustrative embodiments is that the same system and method may be employed for both rust remover and rust inhibitor, and the processes may be conducted in succession. In some embodiments, it is not necessary to clean or purge the dip tank system between treatments. After treatment, reel 100 may be first stored in a drip pan for two days and then stored as usual as is well known to those of skill in the art.

FIG. 10 illustrates a control panel of an illustrative embodiment. As shown in FIG. 10, control panel 200 may include an emergency stop 1000, power button 1005, start button 1010, stop button 1015, ram switch 1020 which is shown in FIG. 10 as a hydraulic pump switch and may provide power to ram 190, fluid transfer pump 150 switch 1025, and rotation switch 1030 that may control the direction of rotation of tire drive 175. Power to the dip tank system, including power to the drive tire, bull gear drive 235, ram 190 and/or lift system to position reel 100 in basin 115, and/or fluid transfer pump 150 may be provided by a 120 volt outlet.

An apparatus, system and method for treating ESP power cables has been described. Illustrative embodiments provide a system and method for removing rust from an ESP power cable and/or coating an ESP power cable with rust inhibitor. Illustrative embodiments may treat 100% of an ESP power cable with minimal waste of treatment fluid, and requiring less volume (such as 85-87% less) of treatment fluid than conventional methods. Further, the same system may be used for both rust removal and rust inhibitor application. Illustrative embodiments may require only a small amount of space since only a single reel is needed and no deep pits are required, and may eliminate the need for an overhead crane. Illustrative embodiments may prevent air bubbles between layers of ESP power cable from blocking coverage of treatment fluid coating. Illustrative embodiments may provide improved handling of long, heavy ESP power cables. The treatment of ESP power cables with rust inhibitor using illustrative embodiments may prolong the shelf-life of ESP power cables and permit those cables to be reused multiple times, saving on cost and waste.

An apparatus, system and method for treatment of an ESP power cable has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A method of treating an electric submersible pump (ESP) power cable, the method comprising:

supporting a reel horizontally above a tank on a shaft that extends between a pair of telescoping support members, the reel comprising:

a tubular drum comprising an inner surface and an outer surface, the inner surface having apertures extending between the inner surface and the outer surface, the tubular drum comprising a pair of flanged open ends extending from the outer surface of the tubular drum to an outer circumference of the reel, the shaft extending through a central axis of the tubular drum and the pair of flanged open ends, and the ESP power cable wrapped around the outer surface of the tubular drum to form a plurality of ESP power cable wraps, wherein the inner surface partially encloses a hollow, the hollow having at least one open end, the inner surface positioned radially outward a minimum distance from the central axis of the reel so that when no more than one third of the height of the reel measured from the outer circumference and perpendicular to the central axis of the tubular drum is lowered into a treatment fluid, the hollow is fluidly coupled with the treatment fluid, allowing the treatment fluid to enter the hollow, pass through one or more of the apertures to the outer surface and to come into contact with the ESP power cable;

retracting the pair of telescoping support members to lower the plurality of ESP power cable wraps partially into the tank such that a lower portion of the ESP power cable wraps is submerged in the treatment fluid and the inner surface of the tubular drum is fluidly coupled to the treatment fluid in the tank through the pair of flanged open ends;

rotating the reel around the shaft such that a circumferential portion of each individual wrap the plurality of the ESP power cable wraps encircling the outer surface of the tubular drum is submerged in the treatment fluid at any given time and when no more than one third of the height of the reel measured from the outer circumference is submerged into the treatment fluid; and coating inner wrappings of the plurality of ESP power cable wraps with the treatment fluid when the treatment fluid flows through vents in flanges of the pair of open flanged ends and through the apertures as the reel is rotated.

2. The method of claim 1, wherein the treatment fluid is one of rust remover or rust inhibitor.

3. The method of claim 1, wherein the treatment fluid is rust remover, the rust remover is drained from the tank and then the retracting and rotating are repeated with a rust inhibitor as a second treatment fluid.

4. The method of claim 1, further comprising:

lifting the coated ESP power cable out of the tank by extending the pair of telescoping support members; and draining the treatment fluid from the tank to a treatment fluid storage container.

5. The method of claim 1, wherein rotating the reel comprises successively and repeatedly submerging each circumferential portion of the ESP power cable wraps in the treatment fluid.

6. The method of claim 1, wherein the ESP power cable comprises armor surrounding insulated conductors, and further comprising coating the armor of an innermost wrap of the ESP power cable wraps with the treatment fluid through the apertures in the tubular drum.

7. The method of claim 1, wherein the reel is rotated by a bull gear drive.

8. The method of claim 1, further comprising locking an end of the shaft into a cradle coupled to one telescoping support member of the pair of telescoping support members with a locking bar.

9. The method of claim 1, further comprising straightening the flanges of the pair of open flanged ends of the reel before supporting the reel above the tank.

10. The method of claim 1, further comprising storing the ESP power cable so coated for a period of time on the reel, and deploying the ESP power cable into a production well by unwinding it from the reel.

11. The method of claim 1, wherein the ESP power cable wrapped around the outer surface of the tubular drum is between 4000 and 12,000 feet long.

12. The method of claim 1, wherein the ESP power cable wrapped around the outer surface of the tubular drum weights up to 9 tons.

13. The method of claim 1, wherein the ESP power cable includes between two and twenty layers of cable wrapped around the outer surface of the tubular drum.

14. The method of claim 1, wherein the reel has a seventy-eight inch diameter measured perpendicular to the central axis.

15. The method of claim 1, wherein the reel has a ninety-six inch diameter measured perpendicular to the central axis.

16. The method of claim 1, wherein the tank has a treatment fluid capacity of not more than four-hundred-fifty gallons.

* * * * *